United States Patent [19]

Campbell

[11] 3,961,331

[45] June 1, 1976

[54] LOSSY CABLE CHOKE BROADBAND ISOLATION MEANS FOR INDEPENDENT ANTENNAS

[75] Inventor: Donn V. Campbell, Eatontown, N.J.

[73] Assignee: The United States of America as represented by the Secretary of the Army, Washington, D.C.

[22] Filed: May 21, 1975

[21] Appl. No.: 579,645

[52] U.S. Cl. ..... 343/792; 343/885; 343/821

[51] Int. Cl.[2] ..... H01Q 1/52

[58] Field of Search ..... 343/787, 792, 821, 885

[56] References Cited

UNITED STATES PATENTS 3,879,735 4/1975 Campbell et al. ..... 343/792

*Primary Examiner*—Eli Lieberman

*Attorney, Agent, or Firm*—Nathan Edelberg; Sheldon Kanars; Jeremiah G. Murray

[57] ABSTRACT

A broadband isolation section comprised of a plurality of series connected cable chokes having respective damping resistors shunted thereacross located between at least two dipole antennas mounted one above the other in a generally vertical plane. The isolator section is particularly adapted to be utilized with dipole antennas having respective pairs of radiating elements substantially aligned in a common vertical axis and being fed from respective radio signal sources by feedlines directed along the common vertical axis through the various radiating elements. The cable chokes included in the isolator section are formed from coaxial cable feedlines and the respective damping resistors shunted thereacross are connected to the sleeve or outer conductor of the feedline(s) feeding the upper antenna(s). Thus adjacent antennas have intermediate broadband isolator sections separating them. Additionally, it is preferable to also include cable chokes at the top and bottom of the particular dipole antenna for determining the electrical length of the respective antennas.

11 Claims, 8 Drawing Figures

LOSSY CABLE CHOKE BROADBAND ISOLATION MEANS FOR INDEPENDENT ANTENNAS

The invention described herein may be manufactured and used by and for the Government for governmental purposes without the payment of any royalties thereon or therefor.

BACKGROUND OF THE INVENTION

The present invention relates generally to antennas of electromagnetic radiation and more particularly to broadband isolation apparatus for a dipole antenna array wherein one or more antennas are operated from different radio transmitters.

When several radio signal sources such as transceivers are operated simultaneously in close proximity, it is common to experience receiver overload, desensitization, cross talk or other annoying non-linear effects arising from cross modulation occurring in the receivers. These non-linear effects arise because the local transmitter produces an intense electromagnetic field at the nearby receiving antenna. If the receiver is shielded and has an exceptionally high sensitivity preceding the first mixer stage, then cross modulation may not be troublesome if the receiving and transmitting frequencies are well separated. If the receiver preselection is by itself insufficient to reduce the amplitude of the interferring signal, a narrow band rejection filter placed between the receiver and the antenna may eliminate or alleviate the interference. However, where many different frequencies are used, the rejection filters require adjustment each time the transmitter frequency is changed, placing an extra burden on the radio operators and adding to the overall cost of the system.

It is well known that electrical isolation between two dipole antennas fed from separate radio signal sources is significantly greater when the dipoles are mounted one above the other on the same axis as opposed to being arranged in a broadside relationship with the same relative spacing between feedpoints. However, even where the dipoles are mounted one above the other, respective transmission lines are generally connected from the radio signal sources to the dipole antennas without any regard to the fact that the physical arrangement of the feed transmission line themselves plays a significant role in determining the radiation characteristic, impedance and the electrical isolation between the dipoles.

In addition to the use of quarter-wavelength sleeve chokes, a recent attempt to overcome the above noted problems is shown and described in U.S. Pat. No. 3,879,735 entitled "Broadband Antenna Systems With Isolated Independent Radiators" , Donn V. Campbell, et al. issuing on Apr. 22, 1975, and assigned to the assignee of the present invention. The subject matter of this patent is directed to a common dipole array for at least two separate transceivers adapted to operate simultaneously consisting of a plurality of dipole antennas having minimized electromagnetic coupling therebetween by being mounted one above the other in a generally vertical plane and having respective tubular radiation element pairs substantially aligned along a common generally vertical axis. The two radio transceivers are coupled to a respective dipole by means of a separate feed line which are directed along the common vertical axis through the tubular radiating elements to the respective dipole feedpoints. The feedline for the upper dipole is selectively configured to provide a cable choke on the lower side of the upper dipole and on either side of the lower dipole as well as an isolator section between each dipole. The feedline for the lower dipole is also configured to provide a cable choke on the lower side of the lower side of the dipole and common with the choke thereat formed in the feedline for the upper dipole.

SUMMARY

The present invention is directed to an improved isolator section between in-line antennas comprising a plurality of series connected chokes formed from the coaxial cable feedline running between the antennas and having respective damping resistors shunted across each of the cable chokes, being connected to the sleeve or outer conductor of the coaxial cable to broadband the isolation characteristic over a relatively large frequency range.

DESCRIPTION OF THE PREFERRED EMBODIMENT

An antenna is a conductor so constructed as to either radiate electromagnetic energy, to collect electromagnetic energy, or both. A transmitting antenna converts electrical energy into electromagnetic waves called radio waves which radiate away from the antenna at speeds near the velocity of light. A receiving antenna converts electromagnetic waves which it intercepts into electrical energy and applies this energy to electronic circuits for interpretation. Some antennas such as that concerned with the subject invention are adapted to serve both functions.

Electrical and physical features of antennas are moreover determined by the use to which they are put. Such features will vary with operating frequency, power handling capability, plane of polarization, and desired radiation field pattern. The physical size of an antenna is determined primarily by its operating frequency and power handling capability while its shape and height are determined by the desired radiation field pattern. A half-wave dipole antenna is not only a fundamental element in an antenna system, it is particularly adapted for communications use in applications above 2MHz ($2 \times 10^6$hertz). Basically, the half-wave dipole antenna is comprised of two quarter wave conductors linearly aligned and having the inner extremities excited by an RF generator. Such apparatus is well known to those skilled in the art is well documented in all the literature dealing with the fundamentals of radio transmission.

The subject invention is directed to an improved means for reducing external feedline current over a broad frequency range by introducing regions of high impedance at selected points along the feedlines between adjacent antennas such as dipole antennas.

Figure 1A:
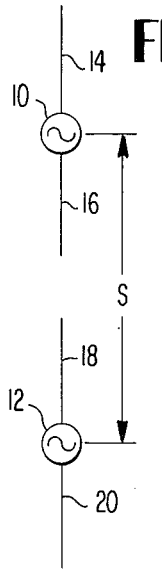
FIGS. 1A and 1B are schematic diagrams illustrative of two possible mounting configurations for two dipole antennas having a predetermined separation therebetween and which are separately fed from diverse RF generators.
Figure 1B:
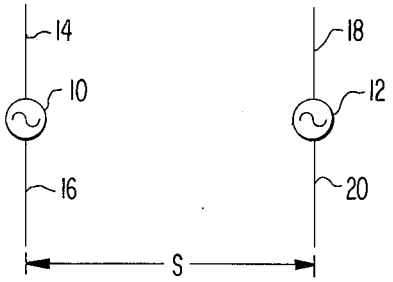

Reference is now made to FIGS. 1A and 1B, wherein two radio signal sources 10 and 12 are separated by a fixed spacing S. The source 10 is coupled to radiating dipole elements 14 and 16, while the source 12 is coupled to dipole elements 18 and 20. The system shown in FIG. 1A is illustrative of a configuration wherein the dipoles are mounted one above the other and being substantially aligned along a common generally vertical axis whereas the configuration in FIG. 1B illustrates a configuration where the elements are arranged in a broadside arrangement wherein the dipole elements 14 and 16 define one common vertical plane while the dipole elements 18 and 20 define a second parallel vertical plane separated from the first by a distance S. It can be shown that it is more desirable when operating radio signal sources 10 and 12 separately to resort to the configuration shown in FIG. 1A, since the electrical isolation between the dipole elements when so arranged is significantly greater than that obtained with the configuration shown in FIG. 1B.

Figure 2:
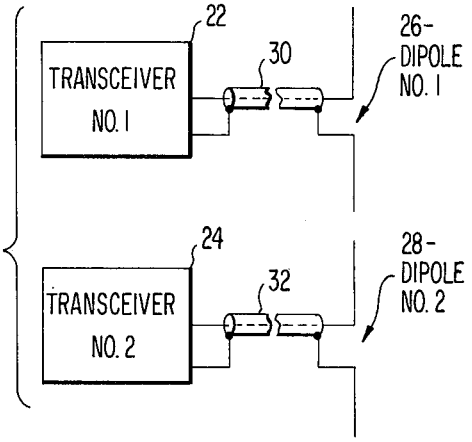
FIG. 2 (PRIOR ART)
FIG. 2 is a schematic diagram illustrative of a pair of axially aligned dipole antennas fed in accordance with prior art practice.

A typical prior art configuration for operating a plurality of transceivers in relatively close proximity to one another is shown in FIG. 2 wherein for example a first and second radio transceiver 22 and 24 are coupled to respective dipole antennas 26 and 28 by means of coaxial feedline transmission lines 30 and 32, respectively. In theory, when the feedlines are ignored, the arrangement shown in FIG. 2 provides considerable isolation between the dipoles because each is located in a region of space where the electromagnetic field of its neighbor is relatively weak. As a practical matter, however, the isolation between the dipoles is usually somewhat less than the theoretical value because of the external current induced from the feedlines 30 and 32 by the dipoles. Thus the radiating system not only consists of the dipole antennas 26 and 28, but also their respective interconnecting feedlines 30 and 32. Such an arrangement has certain inherent limitations, since the physical arrangement of the transmission lines plays a significant part in determining the antenna radiation characteristic, impedance, and the electrical isolation between the antennas.

Figure 3:
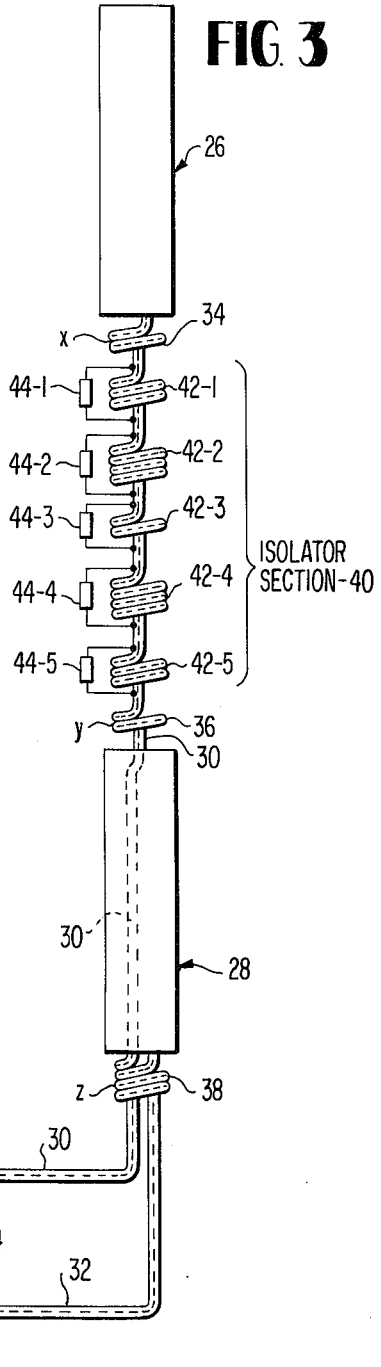
FIG. 3 is a diagram illustrative of the preferred embodiment of the subject invention.

Recognizing the reduction of electromagnetic coupling achieved by the arrangement shown in FIG. 1A, the inventive concept of the subject invention is disclosed for purposes of illustration, but without limitation, in FIG. 3 wherein reference numerals 22 and 24 again designate a pair of transceivers which are coupled to respective dipole antenna assemblies 26 and 28 typically illustrated in the above-referenced U.S. Pat. No. 3,879,735. Moreover, in the configuration shown in FIG. 3, the coaxial feedline 30 is adapted to pass through the dipole elements of the lower antenna 28 to the elements of the upper dipole antenna 26, while the coaxial feedline 32 couples to the elements of the lower dipole antenna 28. In order to improve the operation of the axially aligned dipole assemblies 26 and 28 with the corresponding coaxial feedlines 30 and 32, as shown in FIG. 3, it is necessary to provide regions of high impedance at points $x$, $y$ and $z$ in order to reduce electrical excitation of the feedline 30 by both sets of dipole elements comprising the antennas 26 and 28, and the feedline 32 by the lower set of dipole elements comprising antenna 28 and to establish the correct electrical length of the respective dipoles. The latter is provided by the cable chokes 34, 36 and 38 formed in the feedline 30 with the cable choke 38 being a dual or composite cable choke formed in combination with feedline 32. The present invention is directed to an improved isolator section 40 from that shown in U.S. Pat. No. 3,879,735 which is formed in the feedline 30 between points $x$, $y$, i.e. between cable chokes 34 and 36. In order to broadband the minimization of the excitation of the section of feedline 30 between the two dipole antennas 26 and 28, the isolator section 40 consists of a plurality, for example five, selectively configured series connected cable chokes 42-1, 42-2, 42-3, 42-4, 42-5, each tuned to a different frequency and being shunted by respective electrical resistances 44-1, 44-2, 44-3, 44-4, and 44-5 connected to the outer conductor of the coaxial feedline 30. These resistances act as electrical damping resistors to improve the suppression of the feedline current and enhance the average isolation-bandwidth characteristic of the isolation section 40 over prior art practice as evidenced by the graph shown in FIG. 7.

Figure 4:
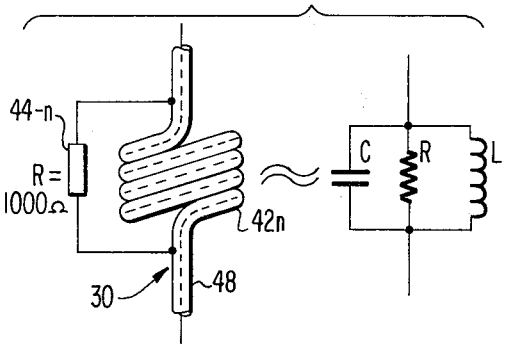
FIG. 4 is a diagram disclosing one type of cable choke utilized in the isolator section illustrative of the preferred embodiment of the subject invention and its electrical equivalent circuit.
Figure 5:
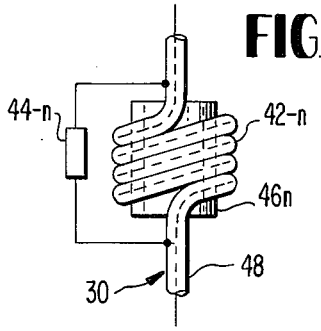
FIG. 5 is a diagram illustrative of a second type of cable choke utilizable by the subject invention.

Referring now to FIGS. 4 and 5, there is disclosed two embodiments of a cable choke 42-n, shunted by a respective damping resistor 44-n. In the configuration shown in FIG. 4, the choke consists of a plurality of self-supported, e.g. by taping, generally circular turns formed in the coaxial feedline 48. Such an arrangement is preferable for operation in the UHF range. When desirable, however, the choke may consist of a plurality of turns wound on a cylindrical plastic form 46-n such as shown in FIG. 5. For operation at HF frequencies, the cable choke may consist of a plurality of turns wound on a torroidal core of ferrite material.

Figure 6:
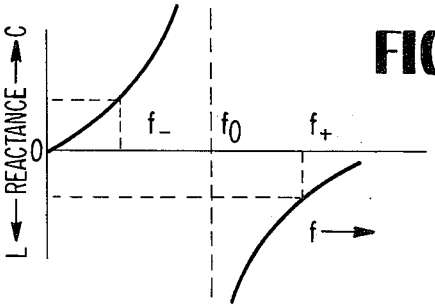
FIG. 6 is a diagram illustrative of the reactance vs. frequency characteristic of the cable chokes shown in FIGS. 4 and 5.

The cable choke 42-n and its damping resistor 44-n exhibit an electrical equivalent circuit comprising the parallel resonant combination of an inductance L, a self-capacitance C, a resistance R, with its reactance being a function of frequency $f$, as shown in FIG. 6. Referring now to FIG. 6, the self-capacitance C and the inductance L become parallely resonant at a frequency $$f_0 = \frac{1}{2\pi\sqrt{LC}}.$$

At resonance, the cable choke provides an impedance which is substantially equal to the resistive value R, determined primarily by the value of the damping resistor 44-n shunting the choke and provides a desired impedance characteristic to radio frequency currents flowing on the outside of the outer conductor 48. Below the frequency $f_0$, the impedance characteristic is inductive, but capacitive above the frequency $f_0$ and may exhibit an impedance of $\pm 1$ kilohm to $\pm 5$ kilohm over a 4:1 frequency range. By minimizing the self-capacitance C of the cable choke, the bandwidth $BW = (f_+ - f_-)$ can be made quite large. The addition of the damping resistor 44-n having a value preferably equal to or approximately 1000ohms provides a still further improvement in the overall characteristic of the isolator section 40 by making the frequency response more uniform as illustrated in the graphical illustrations shown in FIG. 7.

Figure 7:
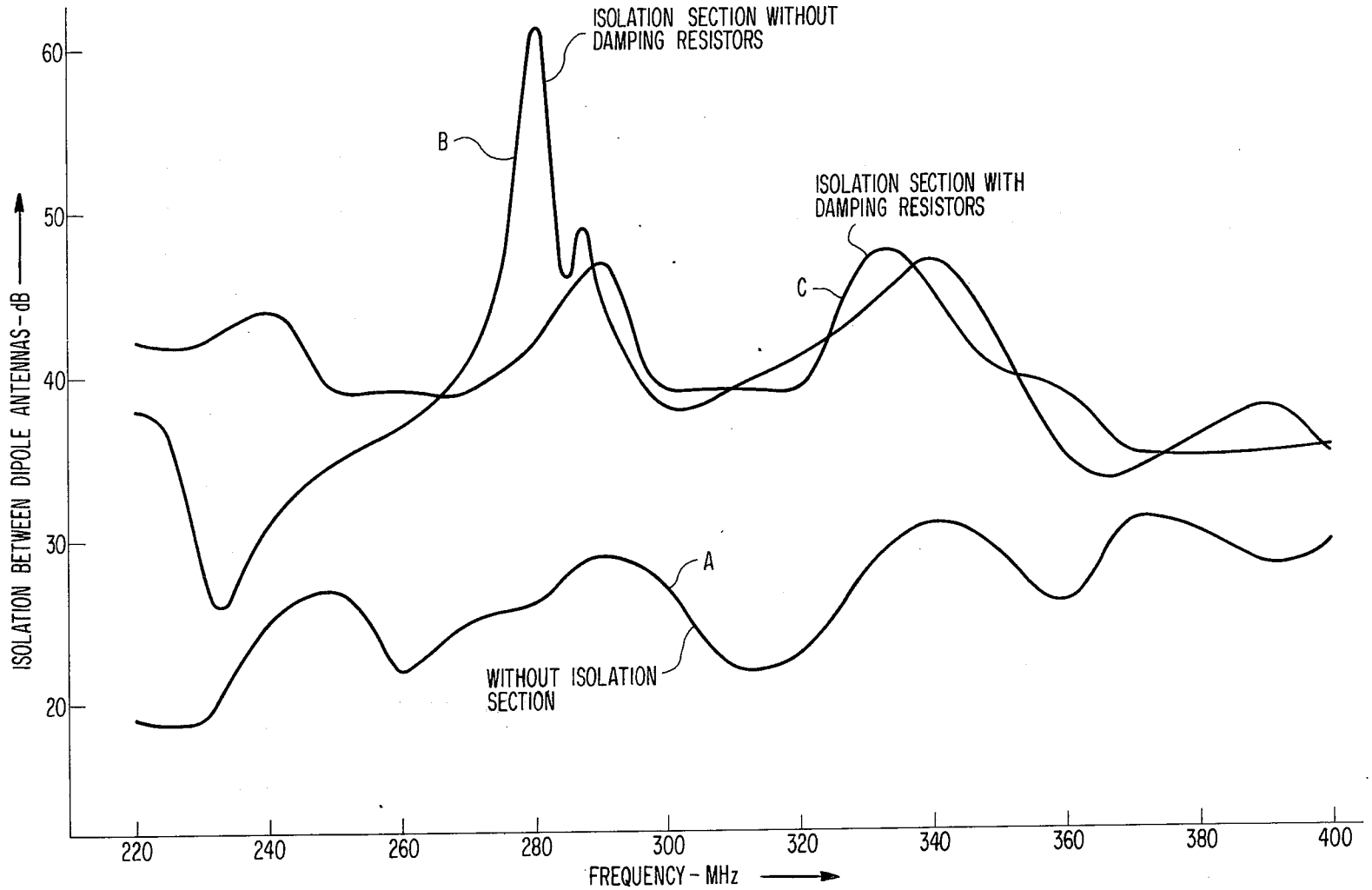
FIG. 7 is a graphical illustration of the performance characteristic of the subject invention relative to prior art apparatus.

Referring now to FIG. 7, curve A illustrates the isolation characteristic provided in a UHF range dual antenna system substantially as shown in FIG. 3, with the exception that the isolator section 40 is deleted. It can be seen that with such an arrangement, an average isolation over the frequency range from 220MHz to 400MHz is in the order of 25dB. Curve B, on the other hand, is illustrative of the isolation achieved over the same frequency range where an isolator section such as shown in U.S. Pat. No. 3,879,735 is utilized but wherein the configuration lacks the damping resistors taught by the subject invention. Curve B indicates that a relatively wide deviation of isolation exists at the lower end of the band decreasing to below 30dB in the region of 230MHz but increasing to an extremely high value in the order of 60dB for a frequency of 280MHz. Curve C, on the other hand, is illustrative of the performance characteristic of the subject invention, which provides a relatively uniform average 45dB of isolation between two UHF dipole antennas operating in the frequency range of from 220 to 400MHz.

It should be pointed out that while the figures disclose a preferred embodiment of the subject invention, this disclosure has been made by way of illustration only, and is not meant to be interpreted in a limiting sense, since when desirable, certain modifications and alterations may be resorted to by those skilled in the art without departing from the spirit and scope of the invention as set forth in the following claims. Accordingly,

I claim as my invention:

1. In a broadband antenna system including at least two dipole antennas respectively coupled to first and second radio apparatus, said antennas being mounted one above the other and having a predetermined spacing therebetween with respective pairs of antenna elements being aligned generally along a common vertical axis and having a first feedline coupling said first radio apparatus to the upper dipole antenna and a second feedline coupling said second radio apparatus to the lower dipole antenna, the improvement comprising:

the first feedline being configured to include an isolator section in said predetermined spacing between said at least two dipole antennas, said isolator section being comprised of a plurality of series connected cable choke sections, each having a respective electrical damping resistor shunted thereacross.

2. The system as defined by claim 1 wherein said first feedline comprises a coaxial cable having an inner conductor and an outer conductor and wherein each damping resistor is coupled to said outer conductor across the respective cable choke.

3. The system as defined by claim 2 where said plurality of cable choke sections are tuned to different frequencies.

4. The system as defined by claim 3 wherein each electrical damping resistor has an electrical resistance value equal to or approximately 1000 ohms.

5. The system as defined by claim 3 wherein said plurality of cable choke sections are comprised of a predetermined number of self-supported turns of said first feedline.

6. The system as defined by claim 5 wherein said turns are generally circular in shape.

7. The system as defined by claim 3 wherein said plurality of cable choke sections are each comprised of a predetermined number of turns of said first feedline wound on a core of plastic material.

8. The system as defined by claim 3 wherein said plurality of cable choke sections are comprised of a predetermined number of turns of said first feedline wound on a generally cylindrical core of plastic material.

9. The system as defined by claim 3 wherein each of said cable choke sections are comprised of a predetermined number of turns of said first feedline wound on a respective magnetic core.

10. The system as defined by claim 9 wherein said core comprises ferrite material.

11. The system as defined by claim 3 wherein said first feedline runs through the lower dipole antenna and is additionally configured to provide an additional cable choke section adjacently below the lower element of the upper dipole antenna and a cable choke section adjacently above the upper radiating element of the lower dipole antenna and a cable choke section adjacently below the lower radiating element of the lower dipole antenna, said cable choke adjacently below the lower radiating element of the lower dipole antenna, also being formed from said second feedline coupled to the lower dipole antenna.

* * * * *